US005082117A

United States Patent [19]

Zimmermann

[11] Patent Number: 5,082,117

[45] Date of Patent: Jan. 21, 1992

[54] CARTON HAVING A POUR SPOUT

[75] Inventor: John Zimmermann, Scarborough, Canada

[73] Assignee: Paperboard Industries Corporation, Toronto, Canada

[21] Appl. No.: 726,832

[22] Filed: Jul. 8, 1991

[51] Int. Cl.[5] ..... B65D 5/70

[52] U.S. Cl. ..... 229/218; 229/229

[58] Field of Search ..... 206/620, 621.3, 621.5, 206/622, 626; 229/125.42

[56] References Cited

U.S. PATENT DOCUMENTS

| | | | |
|---|---|---|---|
| 1,092,148 | 4/1914 | Jones | 206/621.5 |
| 1,203,924 | 11/1916 | Snyder | 206/621.5 |
| 1,975,963 | 10/1934 | Marsh | 206/621.5 |
| 2,313,987 | 3/1943 | Buttery | 206/621.5 |
| 2,349,362 | 5/1944 | Marshall | 206/621.5 |
| 2,364,364 | 12/1944 | Hulton | 206/622 |
| 2,417,498 | 3/1947 | Hulton | 206/620 |
| 2,523,668 | 9/1950 | Read | 229/125.42 |
| 4,802,590 | 2/1989 | Smith | 206/621.5 |

FOREIGN PATENT DOCUMENTS

| | | | |
|---|---|---|---|
| 1248546 | 11/1960 | France | 206/621.3 |
| 342137 | 1/1931 | United Kingdom | 206/621.3 |
| 615161 | 1/1949 | United Kingdom | 206/621.3 |

*Primary Examiner*—Gary E. Elkins

*Attorney, Agent, or Firm*—Fetherstonhaugh & Co.

[57] ABSTRACT

A carton of the type having; first and second main panels and first and second side panels which are connected to one another so as to articulate between a knocked-down compact configuration and an open sleeve configuration. First and second main flaps hingedly are connected to the first and second main panels respectively and first and second side flaps hingedly connected to the first and second side panels respectively. Each of the flaps has a proximal end adjacent and a distal end remote from its associated main or side panel. Pour spout sub-panels are initially formed as integral parts of adjacent first main and first side flaps and are severable from the remainder of the adjacent first main and first side flaps respectively to form a pour spout in use. The adjacent first main and first side flaps each have marginal edge portions located at their distal end outwardly from the pour spout sub-panels with respect to their associatd first main and first side panels respectively. The marginal edge portions being secured to one another in a face-to-face relationship so as to cause the side flap to buckle inwardly upon itself to draw the first main flap toward an outwardly overlying relationship with respect to the first side flap as the carton moves from the knocked-down configuration to the open sleeve configuration to facilitate the closing of a first end of the carton in use.

3 Claims, 3 Drawing Sheets

CARTON HAVING A POUR SPOUT

BACKGROUND OF INVENTION

This invention relates to cartons of the type which have a pour spout.

A carton which has a pour spout that is constructed in a similar manner to that of the present invention has been previously manufactured by Ackerlund & Rausing and is known in the industry as the "Expresso" carton. This carton has a pour spout which is formed by a main flap and an adjacent side flap which are hingedly connected along their adjacent side edges.

The main difficulty which has been experienced with the "Expresso" carton is in the fact that it is very difficult to erect the carton for the purposes of loading the carton. Because the pour spout structure requires that one of the side flaps be connected along its side edge to an adjacent main flap, complex machinery had to be developed in order to permit the end of the carton to be closed during the loading of the carton. The cost of the carton erection equipment has been so great that this carton can only be used by large companies which have the financial resources to permit them to obtain this expensive machinery. It is not possible to close the end of this known type of carton using conventional carton loading machinery.

It is an object of the present invention to provide a carton having a pour spout of the type which is formed by integrally connected side and main flaps which can be erected from a knocked-down configuration to an open configuration for loading without requiring expensive special purpose carton loading machinery.

It is a further object of the present invention to provide for the attachment of portions of a first main and a first side flap to one another during the initial assembly of the cartons into a knocked-down configuration such that when the knocked-down carton is displaced toward an open sleeve configuration during the erection of the carton, the side flap will fold outwardly upon itself and to draw the first main flap toward an outwardly overlying relationship with respect to the first side flap to facilitate the closing of the first end of the carton in use.

SUMMARY OF INVENTION

According to one aspect of the present there is provided, in a carton of the type having: first and second main panels and first and second side panels which are connected to one another so as to articulate between a knocked-down compact configuration and an open sleeve configuration, first and second main flaps hingedly connected to the first and second main panels respectively and first and second side flaps hingedly connected to the first and second side panels respectively, each of said flaps having a proximal end adjacent and a distal end remote from its associated main or side panel and wherein pour spout sub-panels are initially formed as integral parts of adjacent first main and first side flaps and are severable from the remainder of said adjacent first main and first side flaps respectively to form a pour spout in use, the improvement wherein: said adjacent first main and first side flaps each have marginal edge portions located at their distal end outwardly from the pour spout sub-panels with respect to their associated first main and first side panels respectively, said marginal edge portions being secured to one another in a face-to-face relationship so as to cause the side flap to buckle inwardly upon itself to draw the first main flap toward an outwardly overlying relationship with respect to said first side flap as said carton moves from said knocked-down configuration to said open sleeve configuration to facilitate the closing of a first end of the carton in use.

DESCRIPTION OF THE DRAWINGS

With reference to FIG. 1 of the drawings, the reference numeral 10 refers generally to a carton blank suitable for use in the manufacture of a carton in accordance with an embodiment of the present invention.

Figure 1:
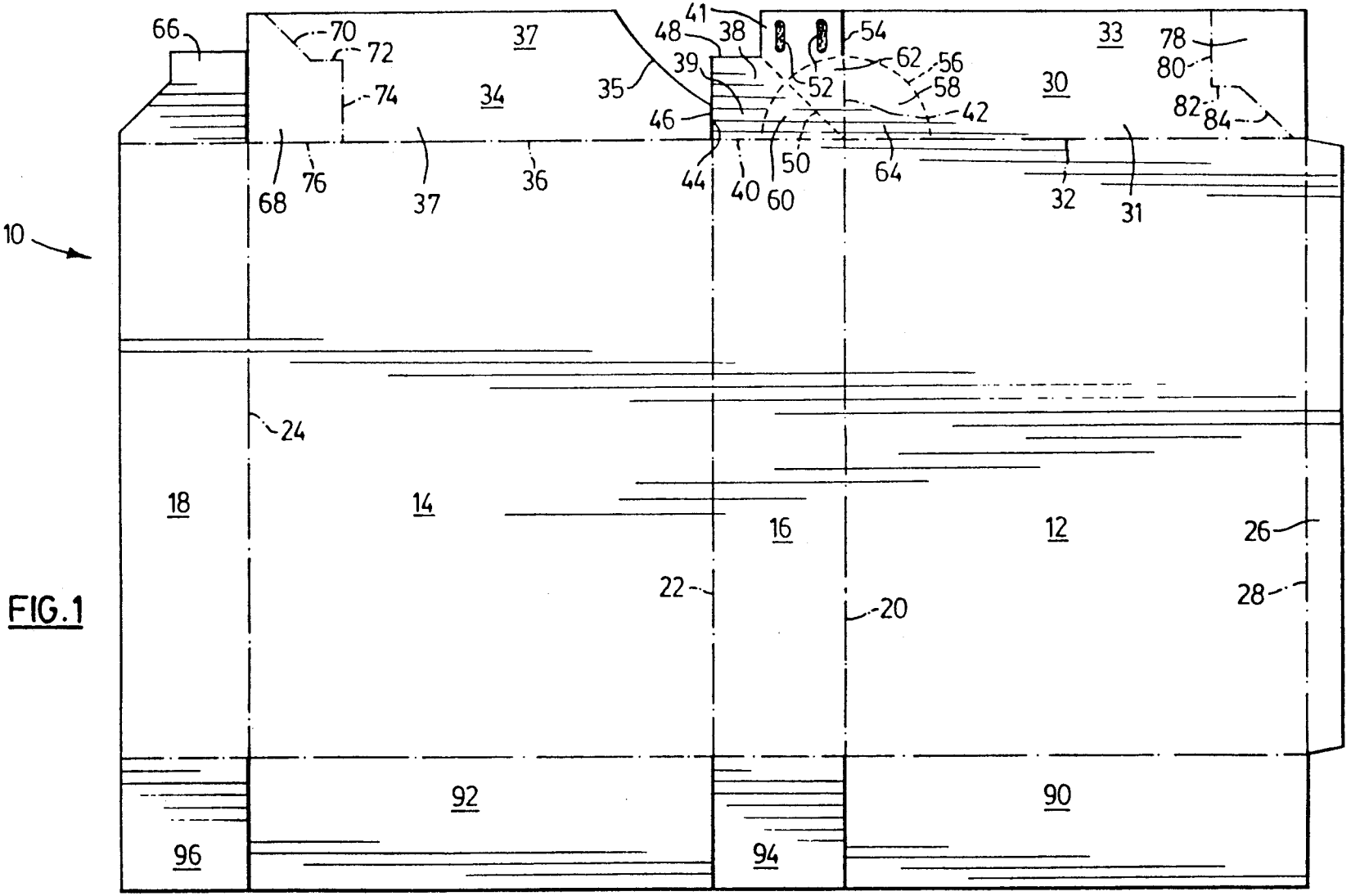
FIG. 1 is a plan view of a carton blank suitable for use in manufacturing a carton according to an embodiment of the present invention.

The carton blank 10 has a first main panel 12, a second main panel 14, first side panel 16 and a second side panel 18. The first main panel 12 is hingedly connected to the side panel 16 along the hinge line 20 and the second main panel 14 is connected to a side panel 16 along the hinge line 22. The second side panel 18 is connected to the second main panel 14 along the hinge line 24. A closure flap 26 is connected to the first main panel 12 along the hinge line 28.

A first main flap 30 has its proximal end 31 hingedly connected to the first main panel 12 along a hinge line 32. The second main flap 34 has its proximal end 37 hingedly connected to the second main panel 14 along a hinge line 36. A first end flap 38 has its proximal end 39 hingedly connected to the first side panel 16 along the hinge line 40 and is hingedly connected to the first main flap 30 along the hinge line 42. The distal ends of the flaps 30, 34 and 38 are identified by the numerals 33, 37 and 41.

The first end flap 38 has a free edge 44 which is free of attachment to the oppositely disposed edge 46 of the second main flap 34. A notch 48 is formed in the first side flap 38 and a diagonal fold line 50 extends from the notch 48 to the intersection of the hinge lines 40 and 42.

A pair of glue patches 52 are located on the inner face of the first end flap 38 on the marginal edge portion 54 which is spaced outwardly from an arcuate shaped tear line 56 of the spout 58.

A spout 58 is formed from sub-panel segments 60, 62 and 64. The sub-panels 60 and 62 are initially formed as an integral part of the end flap 38 and the sub-panel 64 is initially formed as an integral part of the first main flap 30.

A second end flap 66 is integrally connected to the second side panel 18. A shallow depression 68 is formed in the second main flap 34 along the lines 70, 72, 74 and 76. The depression 68 is matched by a similar depression 78 which is formed on the outer face of the main flap 30 and outlined by the depression lines 80, 82 and 84. These depressions serve to accommodate the thickness of the second end flap 66.

A corner portion of the second main flap 34 is removed along the curved line 35 to provide access to the pour spout to facilitate the opening and reclosing of the pour spout as will be described hereinafter.

The bottom closure is of a conventional construction that consists of main flaps 90, 92 and end flaps 94 and 96.

To assemble the carton to its knocked-down configuration the blank that is illustrated in FIG. 1 is folded along the fold line 20. As a result the adhesive bands 52 which are confined to the marginal edge portion of the first side flap 38 will be secured to the marginal edge portion of the main flap 30 in a face-to-face relationship. The carton blank is then folded along the fold line 24 so that the edge of the side flap 18 will overlie the flap 26 and will be secured thereto by the adhesive which has been previously applied to the outer face of the flap 26. As a result of these two simple folding steps the carton is now assembled in its knocked-down configuration.

The carton may now be transported from the carton manufacturer to the package loader.

Figure 2:
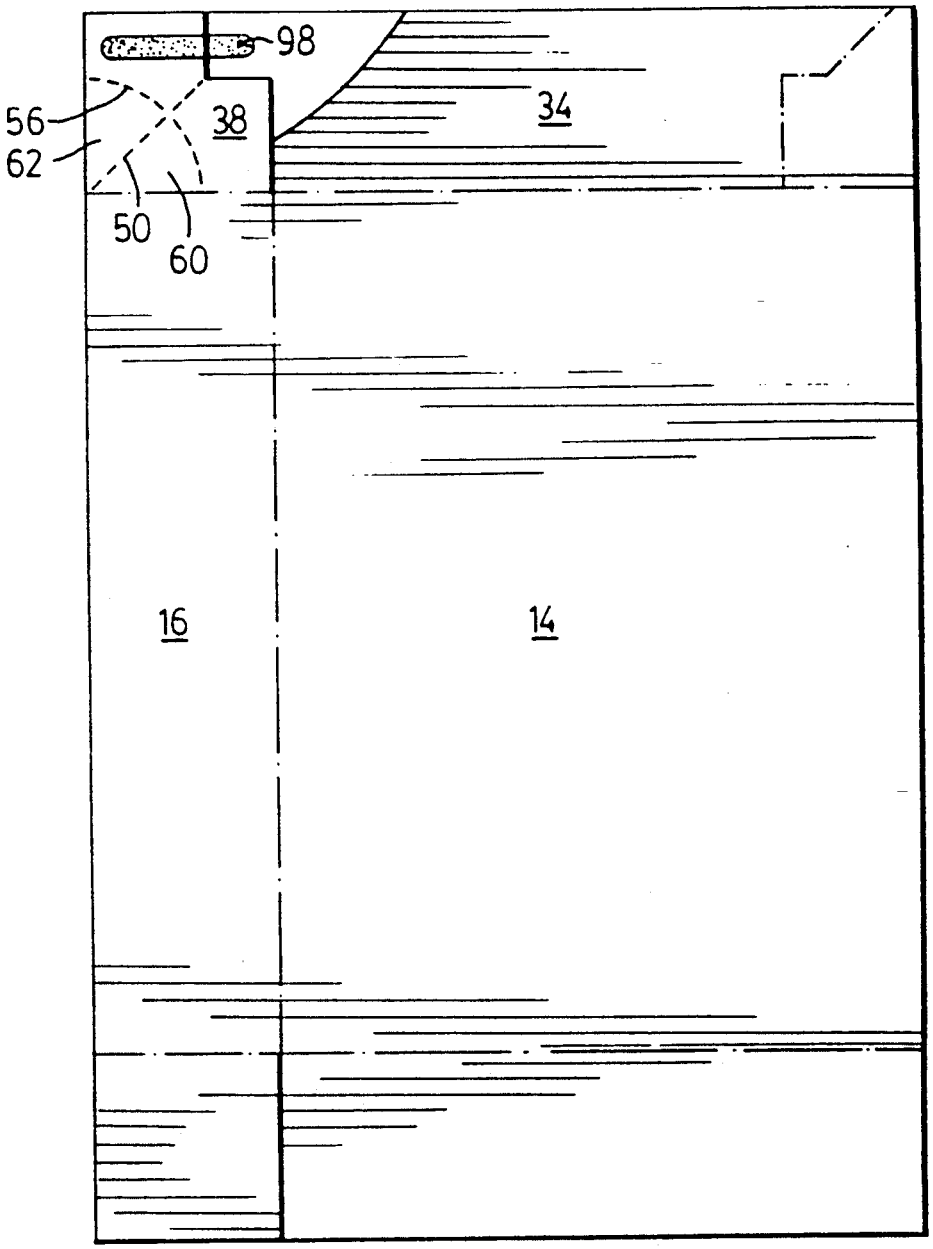
FIG. 2 is a view of the blank of FIG. 1 when folded to a knocked-down configuration.

Immediately before the carton is to be loaded a band of adhesive 98 is applied to the area shown in FIG. 2.

Figure 3:
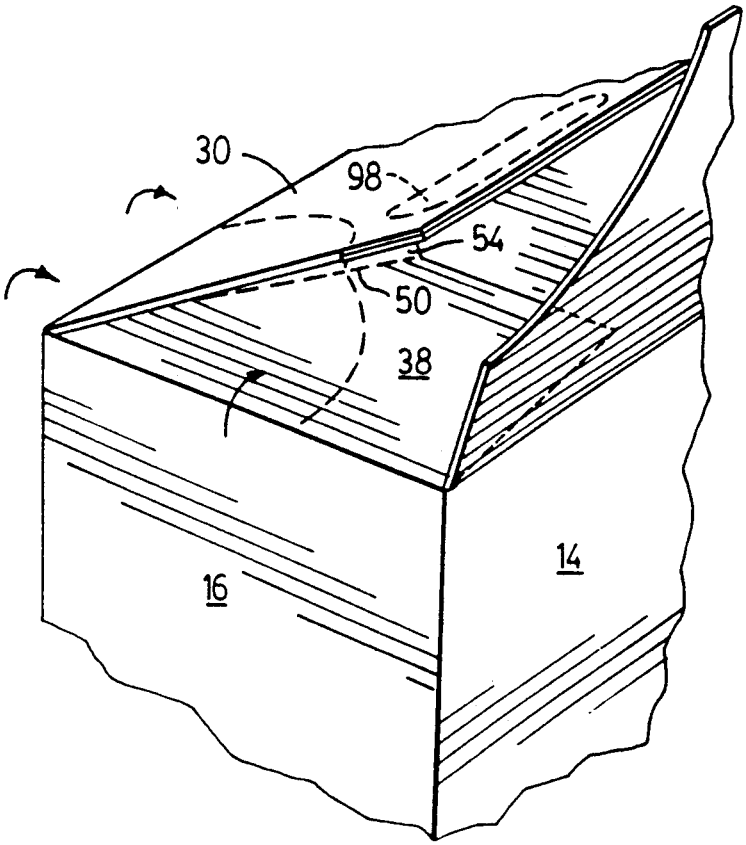
FIG. 3 is a pictorial end view showing a first stage in the movement of the end of the carton to a closed position.
Figure 4:
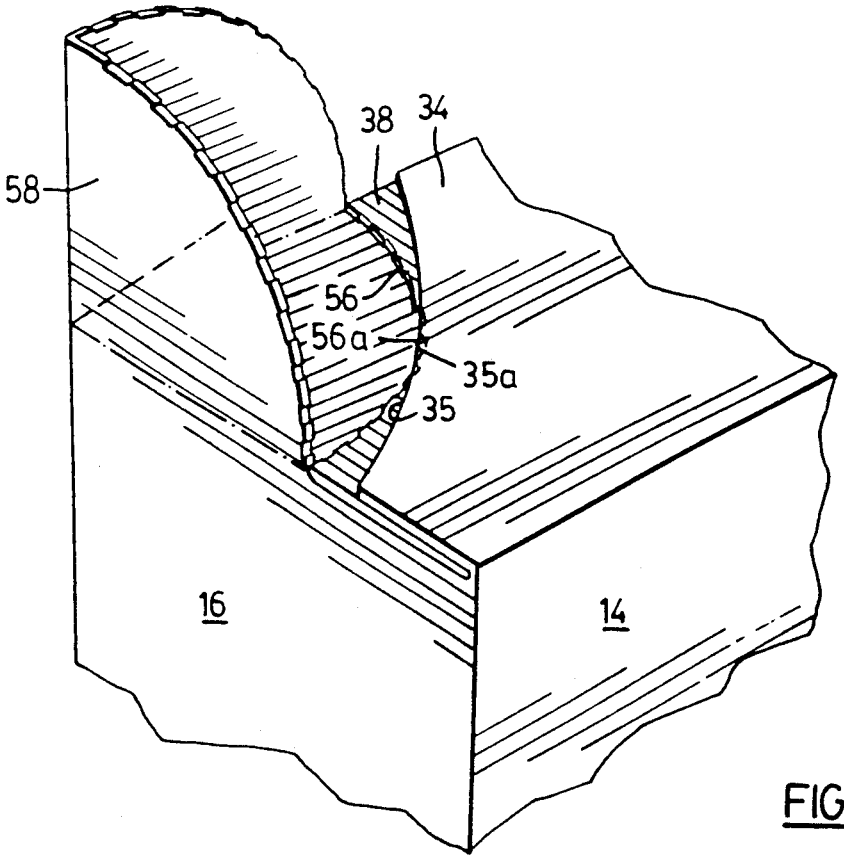
FIG. 4 is a view similar to FIG. 3 showing the carton with the end closed and the pour spout open.

The carton may now be erected to an open sleeve-like configuration for the purposes of filling the carton. Any number of conventional carton opening mechanisms may be used for this purpose. As the carton is displaced toward the open configuration the side flap 38 (FIG. 3) is automatically caused to buckle inwardly by folding along the fold line 50 because of the attachment of the marginal edge portion 54 to the first main flap 30. This action simultaneously causes the first main flap 30 to be drawn inwardly. Flap 66 is then folded to lie on top of flap 30. The carton is closed by pressing the flap 34 into contact with the flap 30.

It will be noted that the curvature of the tear line 56 is such that a minor portion 56*a* underlies a minor portion 35*a* of the flap 34. This overlap is not sufficient to prevent tearing of the spout along the tear line 56 but it does provide a lip under which the spout may be tucked to assume a closed position after it has been opened.

From the foregoing it will be apparent that by the simple expedient of securing the first main and first side flaps in a face-to-face relationship by means of the adhesive which is applied at the patches 52 to the marginal edge portion 54 it is possible to initiate the folding of the flaps toward the closed position to an extent sufficient to commit the subsequent folding to the completely closed position to be carried out by conventional carton loading equipment. As a result of the carton invention it is possible to provide a carton which has a pour spout of the type described that may also be loaded by conventional carton loading equipment.

These and other advantages of the present invention will be apparent to those skilled in the art.

I claim:

1. In a carton of the type having; first and second main panels and first and second side panels which are connected to one another so as to articulate between a knocked-down compact configuration and an open sleeve configuration, first and second main flaps hingedly connected to the first and second main panels respectively and first and second side flaps hingedly connected to the first and second side panels respectively, each of said flaps having a proximal end adjacent and a distal end remote from its associated main or side panel and wherein pour spout sub-panels are initially formed as integral parts of adjacent first main and first side flaps and are severable from the remainder of said adjacent first main and first side flaps respectively to form a pour spout in use, the improvement wherein:

said adjacent first main and first side flaps each have marginal edge portions located at their distal end outwardly from the pour spout sub-panels with respect to their associated first main and first side panels respectively, said marginal edge portions being secured to one another in a face-to-face relationship so as to cause the side flap to buckle inwardly upon itself to draw the first main flap toward an outwardly overlying relationship with respect to said first side flap as said carton moves from said knocked-down configuration to said open sleeve configuration to facilitate the closing of a first end of the carton in use.

2. A carton as claimed in claim 1 wherein adhesive means is provided on said marginal edge portion of said first side flap which serves to secure said distal end of said first side flap to the proximal end thereof when the first side flap is folded upon itself during the closing of the first end of the carton.

3. A carton as claimed in claim 1 wherein a weakened fold line extends diagonally from the proximal end of the first side flap from a point adjacent to the first main flap toward the distal end of the first side flap, said weakened fold line serving to further facilitate the closing of the first end of the carton.

* * * * *